US005869226A

United States Patent [19]

Papai

[11] Patent Number: 5,869,226

[45] Date of Patent: Feb. 9, 1999

[54] CONCENTRATED PHOTOGRAPHIC DEVELOPING SLURRIERS

[75] Inventor: Laszlo Papai, Ballwin, Mo.

[73] Assignee: Trebla Chemical Company, St. Louis, Mo.

[21] Appl. No.: 899,928

[22] Filed: Jul. 24, 1997

[51] Int. Cl.[6] ..... G03C 5/305

[52] U.S. Cl. ..... 430/466; 430/490

[58] Field of Search ..... 430/466, 490

[56] References Cited

U.S. PATENT DOCUMENTS

| | | | |
|---|---|---|---|
| 4,987,060 | 1/1991 | Marchesano | 430/466 |
| 5,187,050 | 2/1993 | Yamada et al. | 430/466 |
| 5,376,510 | 12/1994 | Parker et al. | 430/466 |

*Primary Examiner*—Hoa Van Le

*Attorney, Agent, or Firm*—Marianne Fuierer; Howard M. Ellis

[57] ABSTRACT

Improved concentrated photographic developing slurries having new and desirable characteristics prepared with conventional photographic processing agents eliminate solidification of sedimentation crystals during shipping, storage or extreme temperatures and provide readily solubilized concentrates which upon dilution form working strength photographic developing solutions. The concentrated developing slurries prepared according to these methods are characterized by two phases including an opaque precipitation phase having with a sedimentation comprising inorganic antioxidant agents and a clear phase comprising developing agents dissolved therein.

49 Claims, No Drawings

CONCENTRATED PHOTOGRAPHIC DEVELOPING SLURRIERS

TECHNICAL FIELD

The present invention relates in general to photographic development and in particular to compositions and methods for making concentrated photographic developing slurries, the compositions of which when diluted formulate ready-to-use developing solutions for photographic materials.

BACKGROUND OF THE INVENTION

A wide range of photographic developers are available in both ready-to-use solutions and compounded forms. The compounded forms are liquid concentrates, which have only to be diluted with water to obtain a working strength solution, and powder types which have to be dissolved in solution. Both the ready-to-use and compounded forms present some individual problems ranging from difficulty of uniform mixing of components in the compounded forms to the high cost of shipping the extra weight of water volume in a ready-to-use solution.

The ready-to-use photographic developing solutions are very convenient, but their large size makes shipping more expensive, and the containers take up valuable storage space. To overcome these disadvantages, there has been a trend to reduce the size of the packaging, and thus saving on the shipping cost. One way to achieve this goal is to make either an all-powder developer or a liquid concentrate developer.

Typically, powder mixes are dissolved and brought to working strength with the addition of water. However, powdered photographic developers can be difficult to dissolve, especially if caking of the powder components occurs. In certain circumstances the solution may need to be heated to increase solubility of the components and to form a completely homogeneous solution. Furthermore, in some types of powder mixes it is necessary to package the components separately because of possible interactions between alkali constituents and the developing agents.

Liquid concentrates are an alternative to the powder mixes, but because of the higher water volume they are more expensive to ship than the powder mixes. While, a higher degree of concentration will reduce some of the volume of water it also presents several additional problems. Because of the high dilution required to obtain working strength solutions, the concentrates usually contain maximum levels of photographic processing ingredients. In fact, in a highly concentrated liquid developer solidification of the components can be encountered during shipping, storage, or temperature extremes. The solidification forms a rock hard layer which is practically impossible to remove from the packaging material and makes it difficult to effect re-solution of the concentrate.

Typically, in the preparation of a liquid concentrate the mixing order of the components is not considered critical. The developing agent is not usually added until late in the mixing process to protect the developing agent. But, this can present a problem with homogeneity in the concentrate because the developing agent will not always dissolve in a solution which may be saturated with previously added photographic processing components. Instead, the developing agent will form large undissolved chunks that float on the surface of the concentrate and make subsequent diluting of the liquid concentrate quite difficult.

Accordingly, there is a need for improved concentrated liquid developers which can be shipped economically and require minimal storage space, without undergoing solidification of the active components and which can be easily reconstituted by the user.

SUMMARY OF INVENTION

In accordance with this invention it has been discovered that liquid concentrated developing slurries can be prepared in a particular mixing order to reduce the over-all volume of the concentrate and eliminate solidification of crystals which may settle out during storage, shipping and temperature extremes, thereby achieving easy and complete solubility of all the components upon dilution.

The present invention is predicated upon the discovery that liquid concentrated developing slurries having new and desirable characteristics may be prepared with conventional photographic processing agents, according to the following steps of:

(i) providing an aqueous solution comprising an inorganic antioxidant agent;

(ii) mixing at least one developing agent with the aqueous solution wherein particulates of the developing agent are dispersed in the aqueous solution of step (i);

(iii) introducing a chelating agent to the aqueous solution of step (ii);

(iv) adjusting the pH of the aqueous solution of step (iii) to a range sufficient to produce sedimentation comprising the inorganic antioxidant agent to form the concentrated photographic developing slurry; and (v) introducing at least one photographic processing agent into the concentrated photographic developing slurry of step (iv).

The pH of the aqueous solution containing the inorganic antioxidant agent, developing agent and chelating agent is adjusted in the alkaline range from about 8.5 upwards which precipitates at least the inorganic antioxidant agent as crystal sedimentation and the developing agent which was dispersed as particulates in the aqueous solution becomes solubilized in the concentrated photographic developing slurry.

This invention also provides for an improved concentrated photographic developing composition in the form of a liquid slurry concentrate which can be readily diluted by adding water when needed. This concentrated developing slurry comprises:

(i) an inorganic antioxidant agent;

(ii) at least one developing agent;

(iii) a chelating agent;

(iv) a pH adjusting agent;

(v) at least one photographic processing agent, the concentrated developing slurry being characterized by multiple phases including a precipitation phase having sedimentation comprising the inorganic antioxidant agent and a clear phase comprising the developing agent which is dissolved therein. Upon settling of the concentrated developing slurries the precipitation phase comprising the inorganic antioxidant agent appears as a lower opaque layer. The clear phase is an upper layer comprising the developing agent.

DESCRIPTION OF THE PREFERRED EMBODIMENTS

The present invention is particularly concerned with liquid developing concentrates utilized as developers for various films and papers in graphic art, medical X-Ray, industrial X-Ray, dental X-Ray and other related applications. The improved methods of mixing conventional photographic processing agents provide concentrated photographic developing slurries which eliminate solidification of the components during shipping, storage or temperature extremes. The liquid concentrates are readily solubilized upon dilution with water to form photographic developing solutions of working strength.

It is well known in the photographic processing art to utilize antioxidant agents in developing solutions to act as preservatives. The antioxidant agent has an affinity for oxygen, and when used in a developing solution it tends to attract oxygen from the air and water in preference to other active components in the developing solution. A wide variety of effective antioxidant agents known in the photographic developing art may be utilized in this invention. The most common and most universally used inorganic antioxidant agents include alkali metal sulfites. Representative examples comprise sodium sulfite, potassium sulfite, sodium bisulfite, potassium bisulfite, sodium metabisulfite, and potassium metabisulfite. Sufficient inorganic antioxidant agent is used to combine with oxygen first and achieve substantially optimum preservation of other active components in the developing solution. Generally an amount is needed which is sufficient to counteract the tendency of other active components to oxidize rapidly and lose their effectiveness. More specifically, optimum preservation is achieved with amounts from about 20 to about 40 percent based on total weight of the concentrated slurries of this invention, and more optimally in an amount from about 25 to about 35 percent based on total weight.

The aqueous solution comprising an inorganic antioxidant agent may be prepared by dissolving the inorganic antioxidant agent in water in a sufficient amount to prepare a solution having a 40 to 50 percent concentration of the inorganic preservative salt, or for greater convenience, a pre-mixed aqueous solution may be utilized with a concentration in the 40 to 50 percent range.

Photographic development is the chemical reduction to metallic silver of silver halide crystals which have a latent image due to light exposure. Developing agents reduce exposed silver halide to metallic silver while not affecting the unexposed silver halide. Developing agents are suitable for use in this invention if they are capable of differentiating between the exposed and non-exposed silver halide crystals.

Developing agents for silver halide emulsions which are well known among those skilled in the art and widely used in the photographic industry can be advantageously employed in this invention. Representative developing agents may be selected from compounds having the general formula of $$\alpha—(AH{=}BH)_n—\alpha' \quad (I)$$

where A is carbon, and B is either carbon or nitrogen, n is zero or any integer, and $\alpha$ and $\alpha'$ are independently selected from the group consisting of —OH, —$NH_2$, —$NHR_1$, —$NR_1R_2$, where $R_1$ and $R_2$ are independently selected from the group consisting of a straight or branched, unsubstituted and substituted alkyl having 1 to 4 carbon atoms, where substitution of one or more of the hydrogens can be hydroxy, unsubstituted and substituted amino, where substitution of one or more of the hydrogens can be hydroxyalkyl having 2 to 5 carbon atoms, and aminoalkyl having 2 to 3 carbon atoms; hydroxysulfonalkyl having 2 to 4 carbon atoms; cycloalkyl having 3 to 4 carbon atoms; unsubstituted and substituted hydroxyalkyl having 2 to 5 carbon atoms, where substitution of one or more of the hydrogens can be hydroxy; unsubstituted and substituted aryl, where substitution of one or more of the hydrogens can be hydroxy, methyl, or amino; carboxyalkyl having 1 to 2 carbon atoms, or where $R_1$ and $R_2$ together are a heterocyclic ring having 3 to 6 carbon atoms; and where substitution of one or more of the hydrogens in formula (I) can be methyl, methoxy, bromo, chloro, hydroxy or amino. Preferred representatives of useful developers within formula (I) include hydroquinone, pyrocatechol, 1-phenyl-3-pyrazolidone, p-aminophenol, p-methylaminophenol, p-phenylenediamine, and 2:4-diaminophenol.

Generally developing agents should be used in an amount which is sufficient to preferentially reduce the silver halide grains of the emulsions which have been exposed to light. The developing agent is typically present in an amount from about 5 to about 20 percent based on total weight of the concentrated slurries of this invention. More specifically, reduction of exposed silver ions occurs when the developing agent in the concentrated slurries is from about 8 to about 15 percent based on total weight.

Developing or reducing agents of the type described above are readily oxidized by the air and provisions have made in these improved concentrated developing slurries to guard against deterioration through such oxidation by the presence of the earlier discussed inorganic antioxidant agents.

The aqueous solution containing the inorganic antioxidant agent and developing agent typically has a pH from about 6 to about 8 wherein the antioxidant agent is dissolved and particulates of the developing agent are dispersed. Common developing agents are usually not solubilized in this pH range or function to a useful extent and instead are dispersed as a suspension in the aqueous solution. One of the important aspects of adding the developing agent early in the preparation of these improved concentrated developing slurries is the incorporation of the developing agent into the aqueous solution before it is totally saturated with other photographic processing agents and unable to accept further components.

In the developing of photographic images, a chelating agent is often utilized in developing solutions to form stable, soluble complexes with trace metal impurities in the solution. Most chelating agents utilized in photographic developing solutions may be utilized successfully in this present invention. Particularly useful examples of chelating agents may include ethylenediaminetetraacetic acid (EDTA), sodium diethylenetriaminepentaacetate ($DTPANa_5$), triethylenetetraminehexaacetic acid, hydroxyethylethylenediaminetriacetic acid, nitrilotriacetic acid (NTA), 1:2-diaminocyclohexanetetraacetic acid, 1:3-diamino-2-propanoltetraacetic acid, dipicolinic acid, bis-hydroxyphenylethylenediaminediacetic acid, sodium hexametaphosphate, tetrasodiumpyrophosphate, sodium tripolyphosphate, and sodium trimetaphosphate. Preferably, $DTPANa_5$ is a useful example to eliminate impurities in the aqueous solution.

Generally, chelating agents should be used in a sufficient amount to be effective in complexing unwanted impurities in the developing solution. More specifically, the chelating agent is present in the concentrated slurries in an amount from about 1 to about 5 percent based on total weight of the concentrated slurries, and more preferably, from 2 to 4 percent based on total weight.

In order to form the desired concentrated slurries the pH of the aqueous solution containing the antioxidant, developing and chelating agent is adjusted, preferably from about 8.5 upwards. The adjustment of the pH in the aqueous solution containing the inorganic antioxidant, developing, and chelating agent is accomplished with the introduction of a base. As employed herein, the term "base" refers to a substance that produces hydroxide ions in aqueous solution, or a substance that can accept a proton. Practically any base that is suitable for photographic processing can be utilized to adjust the pH sufficiently to cause sedimentation of the inorganic antioxidant agent. These may include nitrogen bases, such as ammonia, alkali metal or alkaline earth metal hydroxides, such as sodium hydroxide, potassium hydroxide and barium hydroxide, and organic bases with a $K_B$ greater than $1\times10^{-4}$, such as methyl amine.

Generally the pH adjusting agent should be used in an amount sufficient to be effective in raising the pH of the aqueous solution containing the antioxidant, developing and chelating agent to a range from about 8.5 to about 12, and more preferably, in a range from about 10 to about 11. The pH adjusting agent is typically present in an amount from about 2 to about 10 percent based on total weight of the concentrated slurries. In practicing the invention, it is advantageous to employ sodium hydroxide in an amount from about 3 to about 6 percent based on total weight.

With the addition of the base an increase in the pH of the aqueous solution is obtained, and with this increase the developing agent becomes more soluble, while at least the inorganic antioxidant agent crystallizes and precipitates out of solution. A two phase slurry is formed, a clear phase in which at least the developing agent is solubilized, and a precipitate phase having sedimentation comprising the inorganic antioxidant agent in a crystallized form with a cloudy or turbid appearance. Sedimentation of the crystals forms a lower layer phase, but surprisingly there is no solidification of the crystals occurring within this layer even with decreased temperatures or extended storage. To illustrate the superiority of the slurry concentrates of this invention, a mere shaking of the package containing the two-phase concentrated photographic developing slurry will immediately mix the two phases and the slurry can be transferred to another container for dilution with water.

In a typical liquid developing concentrate there are many other photographic processing agents which are added to secure special results. Some of these additional compounds will be considered including solubilizing agents, organic and inorganic restrainer agents, buffering agents and additional developing agents.

Use of organic restrainers in photographic developers are utilized to inhibit the production of fog. In practical photography, fog is regarded as a disadvantage. When the developing agent acts on an emulsion layer, some of the silver halide grains which were not exposed to light are still reduced to metallic silver. The density obtained in the unexposed portions of the image is known as fog. In general, organic restrainers delay the initial appearance of the image and prolong the development required while diminishing the production of fog. A wide variety of different antifoggants known in photographic processing may be effectively used in this invention to control fog and decrease the rate of development of the latent image. Especially useful compounds include benzotriazole, 5-methyl benzotriazole, 5-phenyltetrazole, 6-nitro-benzimidazole and phenylmercaptotetrazole. Generally, organic restrainer agents should be used in a sufficient amount to be effective in inhibiting production of fog on the print. The organic restrainer is typically present in an amount less than 1 percent based on total weight of the concentrated slurries of this invention. Preferably, both benzotriazole and phenyl-mercaptotetrazole are added to the concentrated developing slurries in an amount from about 0.05 to about 0.10 percent total weight.

A solubilizing agent or wetting agent is introduced into the developing slurry to increase the solubility of the developer and to act as a wetting agent. The wetting agent improves the coatability of the film as it enters the developer by the elimination of air bubbles. Any conventional wetting agent utilized in photographic processing can be introduced to ensure rapid and uniform penetration of the film emulsion by the developing slurries of this invention. There are two basic types of solubilizing or wetting agents such as the anionic type which includes compounds of the type $RSO_3Na$ and $RSO_4Na$ wherein R is an alkyl group having 5 to 20 carbon atoms which may contain cyclic substituents; and the non-ionic type compounds, such as polyethyleneglycol derivatives and saponin. Generally, the solubilizing agent should be used in a sufficient amount to be effective in wetting the film as it enters the developing solution. More specifically, the solubilizing agent is present in an amount from about 3 to 8 percent based on the total weight of the concentrated slurries. Preferably, the solubilizing agent diethylene glycol is added to the concentrated slurry in an amount from about 4 to about 6 percent based on total weight of the concentrate.

It is well known in photographic art that a mixture of developing agents causes the velocity of development to increase greater than the sum of the velocities of the individual developers alone. It is generally accepted that one developing agent is adsorbed to the emulsion grains and reduces the silver ions. Subsequently, the adsorbed oxidation product is regenerated by another developing agent. This superadditivity is the reason for the introduction of a second developing agent into the concentrated developing slurry. Developing agents which are well known among those skilled in the art and widely used in the photographic industry can be advantageously employed in this invention. Particularly useful compounds include 4-hydroxymethyl-4-methyl-1-phenyl-3-pyrazolidone, 1-phenyl-4, 4-di-methyl-3-pyrazolidinone and 1-phenyl-3-pyrazolidone. Generally a second developing agent should be used in an amount which is sufficient to increase the velocity of the developing process. It is preferable that the concentrated slurries contain a second developing agent in an amount from about 0.05 to about 2 percent based on the total weight of the slurries. Optimum boosting of the velocity of the development occurs when 4-hydroxymethyl-4-methyl-1-phenyl-3-pyrazolidone, is introduced to the concentrated slurries in an amount from about 0.08 to about 1.5 percent based on total weight.

When development of silver halide takes place a hydrogen ion is produced for each atom of metallic silver formed. In order that the rate of development will not be slowed by a local drop in pH value, these hydrogen ions must be rapidly neutralized by an abundance of hydroxyl ions. Hence, the developer must have an alkaline pH, and more importantly, there must be a large reservoir of potential hydroxide ions. Therefore, the solution must be well buffered. Because the activity of a developer depends on a large part upon the pH of the solution, most developers contain a buffering agent, whose function it is to maintain the proper pH for the desired activity level. Accordingly, most buffering agent known in photographic developing may be utilized in this invention to obtain and maintain a limited pH range. Specific examples of effective buffering agents include sodium bicarbonate, sodium carbonate and potassium carbonate. Generally the buffering agent should be used in an amount sufficient to maintain a limited pH range for enhancing the effect on development of the emulsions. More preferably, a buffering agent is present in an amount from about 3 to about 15 percent based on total weight of the concentrated slurries. One useful buffering agent, sodium bicarbonate, is introduced in an amount ranging from about 5 to about 10 percent based on total weight of the slurry.

Inorganic restrainer agents in combination with organic restrainer agents are utilized in photographic developers. As stated above organic restrainer agents are utilized to restrain fog production, whereas an inorganic restrainer, is used to stabilize the developer in terms of exhaustion life due to the release of soluble bromides during processing. The selectivity of the developing agent is increased because the developer is prevented from reducing unexposed silver grains to metallic silver, while leaving it free to produce a metallic silver image from the exposed grains. Specific examples of particularly useful inorganic restrainers include alkali metal bromide salts, such as potassium bromide, and sodium bromide. Typically, an amount of an inorganic restrainer is introduced which is sufficient to achieve a substantially optimum image of the desired contrast. More particularly, optimum contrast is achieved with the addition of a soluble bromide ranging from about 1 to about 6 percent based on total weight of the slurries of this invention. More optimally, inorganic restrainer agent, sodium bromide is added in an amount from about 2 to 4 percent based on total weight.

A full explanation for the superior characteristics of the concentrated photographic developing slurries in accordance with the invention has not yet been arrived at. Without limitation and by way of theory only, it has been suggested that by combining the photographic processing agents in the disclosed order, e.g., by mixing a developing agent with an aqueous solution containing an inorganic antioxidant agent, the aqueous solution still has enough capacity to incorporate the developing agent which is dispersed as a suspension. With the addition of the chelating agent, impurities in the solution and developing agent are removed by complexing with the chelating agent. Subsequently by adjusting the pH in the alkaline range, the developing agent is solubilized in one phase while at least the inorganic antioxidant agent precipitates out of solution forming seemingly purified crystals that apparently resist increase growth and solidification during shipping, storage or temperature extremes. For other and more particular details concerning the practice of this invention and the advantages thereof, reference is made to the following best mode example.

EXAMPLE

In accordance with the invention, a concentrated photographic developing slurry was prepared in the manner described hereinbelow.

A one liter open flask was equipped with a motorized stirrer. At ambient temperature, an inorganic antioxidant agent, namely 455 grams of potassium sulfite was added to approximately 0.20 liter of deionized water and mixed throughly. Note: (It is possible to pre-mix the potassium sulfite solution having a 45 to 47 percent concentration by placing 690 grams in a one liter volumetric flask, adding water to volume and utilizing 0.68 liter of this pre-mixed solution in this method of preparation.)

Mixed with the aqueous solution containing the potassium sulfite, was 150 grams of a developing agent consisting of hydroquinone. It was observed that the developing agent formed a milky appearance in the aqueous solution. 50 ml of a 40% concentration of $DTPANa_5$, a chelating agent, was added to the aqueous solution containing potassium sulfite and hydroquinone, which was mixed uniformly into the aqueous solution. 65 grams of sodium hydroxide was added to adjust the pH of the aqueous solution to between about 9.5 to about 11 with sodium hydroxide. At least the potassium sulfite then precipitated out of solution and formed a crystallized slurry in the lower half of the mixing flask. At least the developing agent, hydroquinone, which previously appeared as dispersed particles became solubilized in the solution in the upper half of the flask. The aqueous concentrated developing slurry separated into two distinct phases or layers, an opaque lower layer apparently containing the sulfite crystals and a clear upper layer. Because the solution was stirred continuously, the layers were not seen immediately until the stirring mechanism was turned off and the slurry settled.

Additional photographic processing agents were added to the concentrated developing slurry which included the organic restrainer agents benzotriazole and phenylmercaptotetrazole in an amounts of 1.2 grams and 0.15 grams, respectively. Also added to the liquid concentrate, was 50 ml of the solubilizing agent diethylene glycol while mixing for at least two minutes. Approximately 18 grams of 4-hydroxymethyl-4-methyl-1-phenyl-3-pyrazolidone, a second developing agent was added to the slurry and mixed until completely dissolved. A buffering agent was introduced, consisting of 66 grams of sodium bicarbonate, and mixed for at least five minutes. Lastly, 23 grams of the inorganic restrainer, sodium bromide, was throughly mixed into the liquid slurry for 15 minutes.

To test the shelf-life expectancy of the product it was subsequently stored at below freezing temperatures for approximately two weeks. Upon removal from the freezer and with a mere shaking of the container the sulfite crystal sedimentation in the lower layer phase of the slurry was completely dispersed in the solution. The slurry concentrate was then mixed with deionized water to form a working developing solution. The particles were observed to promptly dissolve to form a clear developing solution.

The invention has been described in detail with particular reference to preferred embodiments thereof, but it will be understood that variations and modifications can be effected within the spirit and scope of the invention.

I claim:

1. A method of making a concentrated photographic developing slurry comprising the steps of:

(i) providing an aqueous solution comprising an inorganic antioxidant agent;

(ii) mixing at least one developing agent with said aqueous solution of step (i) wherein particulates of said developing agent are dispersed in said aqueous solution;

(iii) adding a chelating agent to said aqueous solution of step (ii);

(iv) adjusting the pH of said aqueous solution of step (iii) to a range sufficient to produce sedimentation comprising said inorganic antioxidant agent to form said concentrated photographic developing slurry; and (v) introducing at least one photographic processing agent into said concentrated photographic developing slurry.

2. A method according to claim 1 wherein said at least one developing agent is a compound having the general formula of $$\alpha\text{—}(AH{=}BH)_n\alpha' \qquad (I)$$

wherein A is carbon, and B is either carbon or nitrogen, n is zero or any integer, and $\alpha$ and $\alpha'$ are independently selected from the group consisting of —OH, —$NH_2$, —$NHR_1$, —$NR_1R_2$, where $R_1$ and $R_2$ are independently selected from the group consisting of a straight or branched, unsubstituted and substituted alkyl having 1 to 4 carbon atoms, where substitution of one or more of the hydrogens can be hydroxy, unsubstituted and substituted amino, where substitution of one or more of the hydrogens can be hydroxyalkyl having 2 to 5 carbon atoms, and aminoalkyl having 2 to 3 carbon atoms; hydroxysulfonalkyl having 2 to 4 carbon atoms; cycloalkyl having 3 to 4 carbon atoms; unsubstituted and substituted hydroxyalkyl having 2 to 5 carbon atoms, where substitution of one or more of the hydrogens can be hydroxy; unsubstituted and substituted aryl, where substitution of one or more of the hydrogens can be hydroxy, methyl, or amino; carboxyalkyl having 1 to 2 carbon atoms, or where $R_1$ and $R_2$together are a heterocyclic ring having 3 to 6 carbon atoms; and where substitution of one or more of the hydrogens in formula (I) can be methyl, methoxy, bromo, chloro, hydroxy or amino.

3. The method according to claim 1 wherein said at least one developing agent is a member selected from the group consisting of o-dihydroxybenzene, hydroquinone, trihydroxybenzene, p-methylaminophenol and 1-phenyl-3-pyrazolidone.

4. The method according to claim 1 wherein said at least one developing agent is hydroquinone.

5. The method according to claim 2 wherein said inorganic antioxidant agent is a member selected from the group consisting of an alkali metal sulfite and alkali metal metabisulfite.

6. The method according to claim 3 wherein said inorganic antioxidant agent is potassium sulfite.

7. The method according to claim 6 wherein said chelating agent is a member selected from the group consisting of ethylenediaminetetraacetic acid (EDTA), sodium diethylenetriaminepentaacetate ($DTPANa_5$), triethylenetetraminehexaacetic acid, hydroxyethylethylenediaminetriacetic acid, nitrilotriacetic acid (NTA), 1:2-diaminocyclohexanetetracetic acid, 1:3-diamino-2-propanoltetraacetic acid, dipicolinic acid, bis-hydroxyphenylethylenediaminediacetic acid, sodium hexametaphosphate, tetrasodiumpyrophosphate, sodium tripolyphosphate, and sodium trimetaphosphate.

8. The method according to claim 5 wherein said chelating agent is $DTPANa_5$.

9. The method according to claim 1 wherein the step of adjusting said pH further comprises introducing a base.

10. The method according to claim 9 wherein said base is an organic or inorganic base capable of raising the pH above 8.5.

11. The method according to claim 10 wherein said inorganic base is a member selected from the group consisting of sodium hydroxide and potassium hydroxide.

12. The method according to claim 1 wherein said photographic processing agent is a member selected from the group consisting of organic restrainer agent, inorganic restrainer agent, solubilizing agent, buffering agent and a second developing agent.

13. The method according to claim 10 wherein said photographic processing agent is a member selected from the group consisting of organic restrainer agent, inorganic restrainer agent, solubilizing agent, buffering agent and second developing agent.

14. The method according to claim 12 wherein said organic restrainer agent comprises at least one member selected from the group consisting of benzotriazole, 5-methyl benzotriazole, 5-phenyltetrazole, 6-nitrobenzimidazole and phenylmercaptotetrazole.

15. The method according to claim 13 wherein said organic restrainer agent is at least one member selected from the group consisting of benzotriazole and phenylmercaptotetrazole.

16. The method according to claim 12 wherein said inorganic restrainer agent comprises an inorganic alkali metal bromide salt.

17. The method according to claim 15 wherein said inorganic restrainer agent is sodium bromide.

18. The method according to claim 12 wherein said buffering agent is a member selected from the group consisting of sodium bicarbonate, sodium carbonate and potassium carbonate.

19. The method according to claim 17 wherein said buffering agent is sodium bicarbonate.

20. The method according to claim 12 wherein said second developing agent is a member selected from the group consisting of 4-hydroxymethyl-4-methyl-1-phenyl-3-pyrazolidone, 1-phenyl-4,4-di-methyl-3-pyrazolidinone and 1-phenyl-3-pyrazolidone.

21. The method according to claim 19 wherein said second developing agent is 4-hydroxymethyl-4-methyl-1-phenyl-3-pyrazolidone.

22. The method according to claim 12 wherein said solubilizing agent is a member selected from the group consisting of diethylene glycol, saponin, sodium alkyl sulphonates having 5 to 20 carbon atoms and sodium alkyl sulfates having 5 to 20 carbon atoms.

23. The method according to claim 21 wherein said solubilizing agent is diethylene glycol.

24. A composition prepared according to the method of claim 1.

25. A composition prepared according to the method of claim 8.

26. A composition prepared according to the method of claim 13.

27. A composition prepared according to the method of claim 23.

28. A concentrated photographic developing slurry comprising an inorganic antioxidant agent, at least one developing agent, a chelating agent, a pH adjusting agent and at least one photographic processing agent, said concentrated photographic developing slurry being characterized by two phases including a precipitate phase having sedimentation comprising said inorganic antioxidant agent and a clear phase comprising said developing agent dissolved therein.

29. The concentrated photographic developing slurry according to claim 28 wherein said inorganic antioxidant agent is a member selected from the group consisting of an alkali metal sulfite and alkali metal metabisulfite.

30. The concentrated photographic developing slurry according to claim 29 wherein said developing agent is a member selected from the group consisting of o-dihydroxybenzene, hydroquinone, trihydroxybenzene, p-methylaminophenol and 1-phenyl-3-pyrazolidone.

31. The concentrated photographic developing slurry according to claim 30 wherein said chelating agent is a member selected from the group consisting of ethylenediaminetetraacetic acid (EDTA), sodium diethylenetriaminepentaacetate ($DTPANa_5$), triethylenetetraminehexaacetic acid, hydroxyethylethylenediaminetriacetic acid, nitrilotriacetic acid (NTA), 1:2-diamino-cyclohexanetetraactic acid, 1:3-diamino-2-propanoltetraacetic acid, dipicolinic acid, bis-hydroxyphenylethylenediaminediacetic acid, sodium hexametaphosphate, tetrasodiumpyrophosphate, sodium tripolyphosphate, and sodium trimetaphosphate.

32. The concentrated photographic developing slurry according to claim 31 wherein said pH adjusting agent is selected from the group consisting of sodium hydroxide and potassium hydroxide present in an amount sufficient to solubilize said developing agent.

33. The concentrated photographic developing slurry according to claim 28 wherein said photographic processing agent is a member selected from the group consisting of organic restrainer agent, inorganic restrainer agent, solubilizing agent, buffering agent and a second developing agent.

34. The concentrated photographic developing slurry according to claim 33 wherein said organic restrainer agent is at least one member selected from the group consisting of benzotriazole and phenylmercaptotetrazole.

35. The concentrated photographic developing slurry according to claim 33 wherein said inorganic restrainer agent comprises an inorganic alkali metal bromide salt.

36. The concentrated photographic developing slurry according to claim 35 wherein said second developing agent comprises a member selected from the group consisting of 4-hydroxymethyl-4-methyl-1-phenyl-3-pyrazolidone, 1-phenyl-4,4-di-methyl-3-pyrazolidinone and 1-phenyl-3-pyrazolidone.

37. An aqueous concentrated photographic developing slurry which comprises:

(i) an inorganic antioxidant agent;

(ii) at least one developing agent;

(iii) a chelating agent;

(iv) a pH adjusting agent; and (v) at least one additional photographic processing agent, wherein the pH of said slurry is in a range sufficient to produce sedimentation of at least said inorganic antioxidant agent and solubilization of at least said developing agent particulates.

38. The aqueous concentrated photographic developing slurry according to claim 37 wherein said slurry is characterized by sedimentation which is readily solubilized when said slurry is diluted with water.

39. The aqueous concentrated photographic developing slurry according to claim 37 wherein said inorganic antioxidant agent is a member selected from the group consisting of an alkali metal sulfite and alkali metal metabisulfite.

40. The aqueous concentrated photographic developing slurry according to claim 39 wherein said developing agent is a member selected from the group consisting of o-dihydroxybenzene, hydroquinone, trihydroxybenzene, p-methylaminophenol and 1-phenyl-3-pyrazolidone.

41. The aqueous concentrated photographic developing slurry according to claim 40 wherein said chelating agent is a member selected from the group consisting of ethylenediaminetetraacetic acid (EDTA), sodium diethylenetriaminepentaacetate ($DTPANa_5$), triethylenetetraminehexaacetic acid, hydroxyethylethylenediaminetriacetic acid, nitrilotriacetic acid (NTA), 1:2-diaminocyclohexanetetraactic acid, 1:3-diamino-2-propanoltetraacetic acid, dipicolinic acid, bis-hydroxyphenylethylenediaminediacetic acid, sodium hexametaphosphate, tetrasodiumpyrophosphate, sodium tripolyphosphate, and sodium trimetaphosphate.

42. The aqueous concentrated photographic developing slurry according to claim 41 wherein said pH adjusting agent is selected from the group consisting of sodium hydroxide and potassium hydroxide.

43. The aqueous concentrated photographic developing slurry according to claim 37 wherein said photographic processing agent is a member selected from the group consisting of organic restrainer agent, inorganic restrainer agent, solubilizing agent, buffering agent and a second developing agent.

44. The aqueous concentrated photographic developing slurry according to claim 43 wherein said organic restrainer agent is at least one member selected from the group consisting of benzotriazole and phenylmercaptotetrazole.

45. The aqueous concentrated photographic developing slurry according to claim 43 wherein said inorganic restrainer agent comprises an inorganic alkali metal bromide salt.

46. The aqueous concentrated photographic developing slurry according to claim 45 wherein said second developing agent comprises a member selected from the group consisting of 4-hydroxymethyl-4-methyl-1-phenyl-3-pyrazolidone, 1-phenyl-4,4-di-methyl-3-pyrazolidinone and 1-phenyl-3-pyrazolidone.

47. The aqueous concentrated photographic developing slurry according to claim 37 diluted with water to a working strength solution.

48. A composition prepared according to the method of claim 47 wherein said concentrated photographic developing slurry is characterized by two phases including a precipitate phase having sedimentation comprising said inorganic antioxidant agent and a clear phase comprising said developing agent dissolved therein.

49. A method of making a concentrated photographic developing slurry comprising the steps of:

(i) providing an aqueous solution comprising an inorganic antioxidant agent;

(ii) mixing at least one developing agent with said aqueous solution of step (i) wherein particulates of said developing agent are dispersed in said aqueous solution;

(iii) adding a chelating agent to said aqueous solution of step (ii);

(iv) adjusting the pH of said aqueous solution of step (iii) with a base to a range sufficient to produce sedimentation comprising said inorganic antioxidant agent to form said concentrated photographic developing slurry; and (v) introducing an organic restrainer agent, an inorganic restrainer agent, a solubilizing agent, a buffering agent and a second developing agent into said concentrated photographic developing slurry.

* * * * *